US005153365A

United States Patent [19]

Chang

[11] Patent Number: 5,153,365

[45] Date of Patent: Oct. 6, 1992

[54] BELT-TYPE ELECTRIC SHOCK DEVICE

[76] Inventor: Kun-Ming Chang, No. 24, Lane 191, Sec. 4, San-Ho Rd., San-Chung City, Taiwan

[21] Appl. No.: 756,272

[22] Filed: Sep. 3, 1991

[51] Int. Cl.[5] ..... F41B 15/00

[52] U.S. Cl. ..... 89/1.11; 2/311

[58] Field of Search ..... 89/1.11; 2/311, 312

[56] References Cited

U.S. PATENT DOCUMENTS

| | | | |
|---|---|---|---|
| 3,803,463 | 4/1974 | Cover | 89/1.11 |
| 3,971,292 | 7/1976 | Paniagua | 89/1.11 |
| 4,846,044 | 7/1989 | Lahr | 89/1.11 |
| 4,852,454 | 8/1989 | Batchelder | 89/1.11 |
| 4,982,645 | 1/1991 | Abboud | 89/1.11 |

*Primary Examiner*—Charles T. Jordan

*Attorney, Agent, or Firm*—Cushman, Darby & Cushman

[57] ABSTRACT

A belt-type electric shock device includes a belt having a flexible strip and a buckle attached to one end of the flexible strip, a battery operated high voltage generator provided on the belt and generating a high voltage output, and a pair of spaced conductive strips provided on an outer side of the buckle and wired to the high voltage generator so as to receive the high voltage output, thereby causing electric shock to someone who contacts the conductive strips.

8 Claims, 3 Drawing Sheets

BELT-TYPE ELECTRIC SHOCK DEVICE

BACKGROUND OF THE INVENTION

1. Field of the Invention

The invention relates to an electric shock device, and more particularly to an electric shock device that is incorporated in a belt.

2. Description of the Related Art

Personal security devices are known in the art. Examples of such devices include electric shock devices and chemical sprays which are used to shock or temporarily disable a would-be attacker so that a potential victim may have an opportunity to escape. However, a main disadvantage of conventional personal security devices is that they are inconvenient to bring along.

SUMMARY OF THE INVENTION

Therefore, the main objective of the present invention is to provide an electric shock device which can be worn by the user.

More specifically, the main objective of the present invention is to provide an electric shock device which is incorporated in a belt.

Accordingly, the preferred embodiment of the belt-type electric shock device of the present invention comprises: a belt including a flexible strip and a buckle attached to one end of the flexible strip; a battery operated high voltage generating means provided on the belt and generating a high voltage output; and an electrode means including a pair of spaced conductive strips provided on an outer side of the buckle and being wired to the high voltage generating means so as to receive the high voltage output.

The high voltage generating means comprises: a battery cell means having a low dc voltage output; a voltage oscillator circuit including a power supply switch selectively connecting the voltage oscillator circuit to the battery cell means so as to receive the low dc voltage output, a transformer means having a primary winding and a secondary winding, a current limiting resistor connecting one end of the primary winding to one end of the secondary winding so as to regulate output power at the secondary winding, and a transistor means having a collector terminal connected to the other end of the primary winding, an emitter terminal connected to a negative terminal of the battery cell means, and a base terminal, the voltage oscillator circuit further including a resistor means connecting the other end of the secondary winding to the base terminal and a filter capacitor connected across the battery cell means; and a voltage doubler circuit including a first unidirectional current gate having an anode terminal connected to a center tap of the secondary winding, a first capacitor connected across a cathode terminal of the first current gate and the emitter terminal of the transistor means, a second unidirectional current gate having an anode terminal connected to the cathode terminal of the first current gate, and a second capacitor connected across a cathode terminal of the second current gate and the center tap of the secondary winding. One of the conductive pieces is connected to the cathode terminal of the second current gate. The other one of the conductive pieces is connected to the emitter terminal.

When the power supply switch is operated to connect the battery cell means and the voltage oscillator circuit, a pulsating high voltage output is generated across the conductive strips, thereby causing electric shock to someone who comes into contact with the conductive strips.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
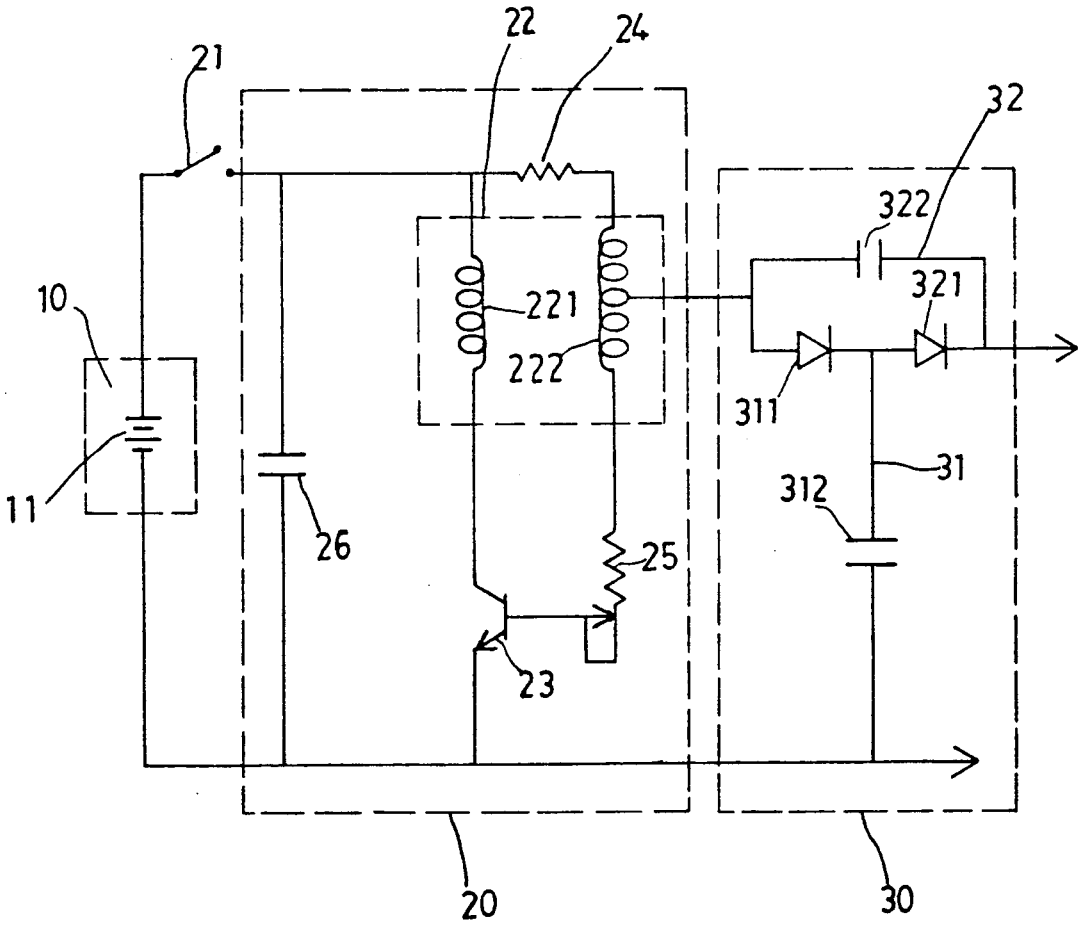
FIG. 1 is a schematic electrical circuit diagram of the high voltage generating means of the belt-type electric shock device of the present invention.
Figure 2A:
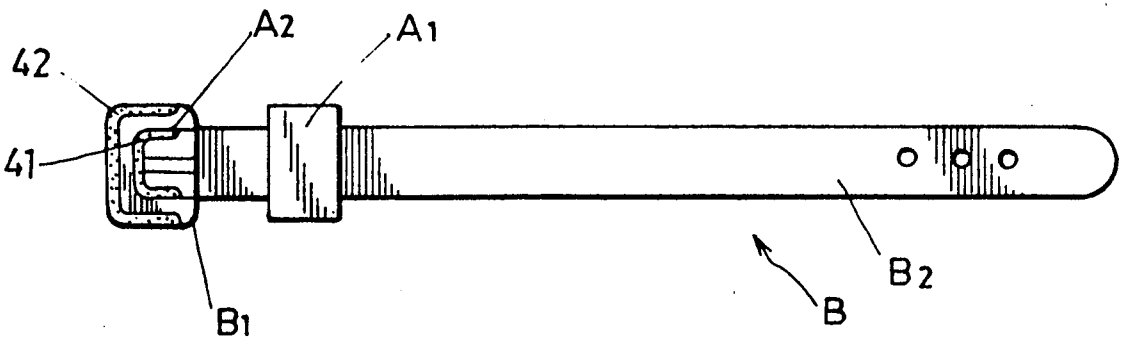
FIG. 2A illustrates a first arrangement of a pair of conductive strips provided on a buckle of the belt-type electric shock device of the present invention.
Figure 2B:
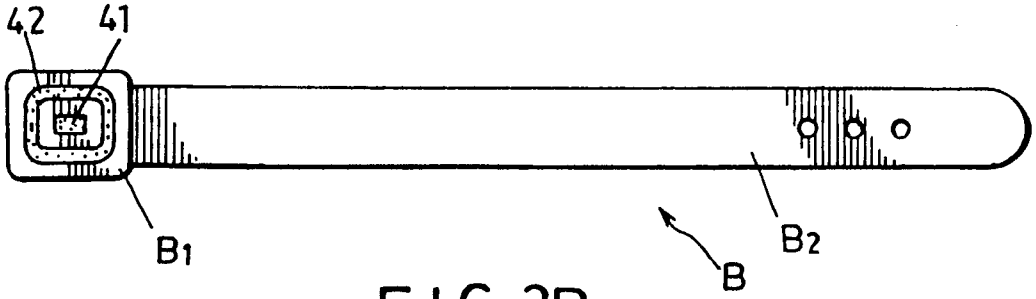
FIG. 2B illustrates a second arrangement of a pair of conductive strips provided on the buckle of the belt-type electric shock device of the present invention.

Referring to FIGS. 1, 2A and 2B, the belt-type electric shock device of the present invention is shown to comprise a high voltage generating means (A1), an electrode means (A2) and a belt (B) including a buckle (B1) provided on one end of a flexible strip (B2). The high voltage generating means (A1) may be provided on an inner side of the buckle (B1) or on the flexible strip (B2) adjacent to the buckle (B1). The electrode means (A2) is provided on an outer side of the buckle (B1). The high voltage generating means (A1) includes a battery cell means 10, a high voltage oscillator circuit 20 and a voltage doubler circuit 30. The electrode means (A2) includes a pair of spaced conductive strips, 41 and 42.

The battery cell means 10 is a small low voltage battery cell 11 which has a 1.5 dc voltage output. The high voltage oscillator circuit 20 is connected to the positive and negative terminals of the battery cell 11 and comprises a power supply switch 21, a transformer 22 and a transistor amplifier 23 to intermittently generate an oscillating voltage. A current limiting resistor 24 connects one end of the primary winding 221 and one end of the secondary winding 222 of the transformer 22. The other end of the primary winding 221 is connected to the collector terminal of the transistor amplifier 23. The base terminal of the transistor amplifier 23 is wired to the variable contact arm of a potentiometer 25. One of the terminal ends of the potentiometer 25 is wired to the other end of the secondary winding 222. The high voltage oscillator circuit 20 further comprises a capacitor filter 26 to be connected across the battery cell 11 to filter out unnecessary ac signals.

The voltage doubler circuit 30 comprises a charge branch 31 and a feedback branch 32. The voltage input to the charge branch 31 is taken from a center tap of the secondary winding 222 and the emitter terminal of the transistor amplifier 23. The charge branch 31 comprises a first unidirectional current gate 311 serially connected to a first capacitor 312. The feedback branch 32 is connected to the center tap of the secondary winding 222 and to the cathode of the first current gate 311 and comprises a second unidirectional current gate 321 and a second capacitor 322.

The conductive strip 41 of the electrode means (A2) is electrically connected to the cathode of the second current gate 321. The conductive strip 42 of the electrode means (A2) is electrically connected to the negative terminal of the battery cell 11. Referring once more to FIGS. 2A and 2B, the conductive strips, and 42, are provided on the outer side of the buckle (B1) and may be configured in different arrangements.

Operation of the present invention is as follows: When the power supply switch 21 is operated to connect the battery cell 11 to the high voltage oscillating circuit 20, current from the battery cell 11 flows through the current limiting resistor 24, the secondary winding 222 and to the potentiometer 25. The potentiometer 25 provides a bias voltage to the base terminal of the transistor amplifier 23, causing the latter to conduct. The potential generated at the primary winding 221 induces a voltage output at the secondary winding 222. Current at the secondary winding 222 flows from the center tap thereof to the first current gate 311 to charge the first capacitor 312. The second capacitor 322 is simultaneously charged via the second current gate 321 in order to produce the required high voltage output.

As the bias voltage at the base terminal of the transistor amplifier 23 gradually increases, the transistor amplifier 23 reaches a saturation state, and no voltage output is detected at the secondary winding 222. The first capacitor 312 then discharges via the second current gate 321, the second capacitor 322, the secondary winding 222 and the potentiometer 25 to once more provide a bias voltage to the transistor amplifier 23 at the base-emitter terminals thereof, thereby causing the transistor amplifier 23 to again conduct. This illustrates how the high voltage generating means (A1) of the preferred embodiment generates one cycle of a high voltage pulse.

Figure 3:
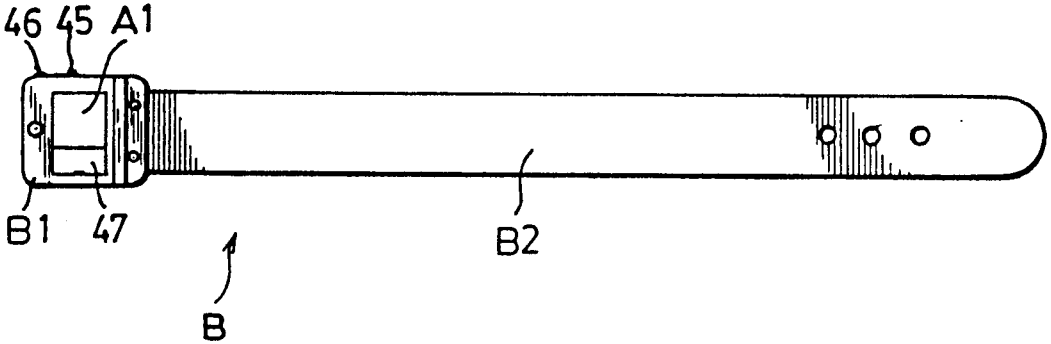
FIG. 3 is an illustration of another preferred embodiment of a belt-type electric shock device according to the present invention.

Referring to FIG. 3, the second preferred embodiment of a belt-type electric shock device according to the present invention is shown to have a buckle (B1) attached to one end of a flexible strip (B2). The buckle (B1) is provided with a manually operated two-section switch 45 and a power supply indicator 46 on a top end thereof. The high voltage generating means (A1) is provided inside the buckle (B1). The buckle (B1) further confines a battery seat 47 to receive the battery cell 11. Thus, in case the power supply switch was accidentally switched on, the power supply indicator 46 will light up to warn the user that the electric shock device is in operation.

An important feature of the present invention is that the current limiting resistor 24 limits the voltage to the secondary winding 222 and the current flowing through the same, thereby regulating the power output at the secondary winding 222.

A second important feature of the present invention is that the potentiometer 25 can be adjusted to vary the rate of discharge of the first capacitor 312 to thereby vary the frequency of the oscillating high voltage output.

The advantages of using the belt-type electric shock device of the present invention are as follows:

1. The output power of the present invention and its voltage output are relatively low, thereby reducing the danger of using the same. The voltage output of a conventional electric shock device ranges from 15 to 18 kilovolts, while its current output ranges from 2 to 3 amperes. The electric shock generated by the conventional electric shock device is thus relatively strong and is dangerous to handle. On the other hand, the voltage output of the electric shock device of the present invention ranges from 2200 to 2400 volts, while its current output is approximately 0.15 amperes. Since the voltage and current outputs are considerably less, the electric shock generated by the present invention is much weaker. The electric shock device of the present invention is thus safer to handle.

2. The present invention is convenient to carry since it is worn like an ordinary belt.

3. The electrode means (A2) is provided in front of the user, thereby reducing the chances of accidental contact. In the event that an attacker forcibly removes the belt, he will contact the electrode means, thereby shocking himself to therefore give the potential victim an opportunity to escape. (Since the purpose of the electric shock device is to scare off the attacker, the current output has been reduced so as to minimize the risk of killing someone).

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A belt-type electric shock device, comprising:

a belt including a flexible strip and a buckle attached to one end of said flexible strip;

a battery operated high voltage generating means provided on said belt and generating a high voltage output; and an electrode means including a pair of spaced conductive strips provided on an outer side of said buckle and being wired to said high voltage generating means so as to receive said high voltage output.

2. The belt-type electric shock device as claimed in claim 1, wherein said high voltage generating means comprises:

a battery cell means having a low dc voltage output;

a voltage oscillator circuit including a power supply switch selectively connecting said voltage oscillator circuit to said battery cell means so as to receive said low dc voltage output, a transformer means having a primary winding and a secondary winding, one end of said primary winding being electrically connected to one end of said secondary winding, and a transistor means having a collector terminal connected to the other end of said primary winding, an emitter terminal connected to a negative terminal of said battery cell means, and a base terminal, said voltage oscillator circuit further including a resistor means connecting the other end of said secondary winding to said base terminal; and a voltage doubler circuit including a first unidirectional current gate having an anode terminal connected to a center tap of said secondary winding, a first capacitor connected across a cathode terminal of said first current gate and said emitter terminal of said transistor means, a second unidirectional current gate having an anode terminal connected to said cathode terminal of said first current gate, and a second capacitor connected across a cathode terminal of said second current gate and said center tap of said secondary winding, one of said conductive pieces being connected to said cathode terminal of said second current gate, the other one of said conductive pieces being connected to said emitter terminal;

whereby, when said power supply switch is operated to connect said battery cell means and said voltage oscillator circuit, a pulsating high voltage output is generated across said conductive strips, thereby causing electric shock to someone who comes into contact with said conductive strips.

3. The belt-type electric shock device as claimed in claim 2, wherein said voltage oscillator circuit further comprises a filter capacitor connected across said battery cell means.

4. The belt-type electric shock device as claimed in claim 2, further comprising a current limiting resistor electrically connecting said one end of said secondary winding and said one end of said primary winding, output power at said secondary winding being regulated by said current limiting resistor.

5. The belt-type electric shock device as claimed in claim 2, wherein said resistor means is a potentiometer, said base terminal being electrically connected to a variable contact arm of said potentiometer, said potentiometer being adjusted to vary the frequency of said pulsating high voltage output.

6. The belt-type electric shock device as claimed in claim 1, wherein said high voltage generating means is provided on said flexible strip adjacent to said buckle.

7. The belt-type electric shock device as claimed in claim 1, wherein said high voltage generating means is provided on an inner side of said buckle.

8. The belt-type electric shock device as claimed in claim 1, wherein said high voltage generating means is provided inside said buckle.

* * * * *